US011090788B2

(12) United States Patent
Huang

(10) Patent No.: US 11,090,788 B2
(45) Date of Patent: Aug. 17, 2021

(54) DISASSEMBLING TOOL

(71) Applicant: SHIFUKANG INDUSTRIAL.CO., LTD., Taichung (TW)

(72) Inventor: Shang-Yuan Huang, Taichung (TW)

(73) Assignee: Shifukang Industrial.Co., Ltd., Taichung (TW)

( * ) Notice: Subject to any disclaimer, the term of this patent is extended or adjusted under 35 U.S.C. 154(b) by 228 days.

(21) Appl. No.: 16/434,653

(22) Filed: Jun. 7, 2019

(65) Prior Publication Data

US 2020/0039041 A1 Feb. 6, 2020

(30) Foreign Application Priority Data

Aug. 2, 2018 (TW) ..... 107126965

(51) Int. Cl.
*B25B 27/06* (2006.01)

(52) U.S. Cl.
CPC ..... *B25B 27/062* (2013.01)

(58) Field of Classification Search
CPC ..... B25B 27/062
USPC ..... 29/263
See application file for complete search history.

(56) References Cited

U.S. PATENT DOCUMENTS 3,785,050 A * 1/1974 Whitledge ..... F16L 13/141 30/237
3,862,483 A * 1/1975 Kloster ..... B25B 27/062 29/257
2019/0030700 A1* 1/2019 Huang ..... B25B 27/062

FOREIGN PATENT DOCUMENTS

DE 202016102589 U1 * 9/2016 ..... B25B 27/064

* cited by examiner

*Primary Examiner* — Lee D Wilson
*Assistant Examiner* — Jonathan G Santiago Martinez
(74) *Attorney, Agent, or Firm* — Muncy, Geissler, Olds & Lowe, P.C.

(57) ABSTRACT

A disassembling tool is provided, including: a main body, a screw rod, a screw barrel and a bearing. The main body includes a first end portion, a second end portion and a receiving space. The first end portion includes a through hole. The screw rod penetrates through the through hole. The screw barrel is screwed on the screw rod. The bearing is sleeved to the screw rod and includes an inner ring, an outer ring and a plurality of rollers. The inner ring includes a first base board and a first annular portion which are transversely connected with each other, and the outer ring includes a second base board and a second annular portion which are transversely connected with each other. The plurality of rollers are abutted against and between the first and second base boards and between the first and second ring portions.

8 Claims, 8 Drawing Sheets

DISASSEMBLING TOOL

BACKGROUND OF THE INVENTION

Field of the Invention

The present invention relates to a disassembling tool.

Description of the Prior Art

Generally, wheel hubs of a vehicle are worn down due to long-term use or abrasion by dust, gravel or other objects. Therefore, regular replacement of the wheel hubs is required for driving safety.

A conventional disassembling tool for disassembling the wheel hubs includes a shaft and a slide hammer. The shaft includes a first blocking edge and a second blocking edge, and the slide hammer is sleeved to the shaft and located between the first and second blocking edges. During operation, the shaft is penetrated through a wheel hub and the first and second blocking edges are located at two opposite sides of the wheel hub, and the second blocking edge is abutted against the wheel hub. An operator has to repeatedly axially strike the first blocking edge by the slide hammer so that the second blocking edge can push the wheel hub in a direction toward the first blocking edge for disassembling the wheel hub.

However, the second blocking edge of the conventional disassembling tool repeatedly strikes the wheel hub and vibrates relative to the wheel hub, which causes that the second blocking edge cannot stably contact the wheel hub and the disassembling tool is inconvenient to be operated.

The present invention is, therefore, arisen to obviate or at least mitigate the above-mentioned disadvantages.

SUMMARY OF THE INVENTION

The main object of the present invention is to provide a disassembling tool which is convenient for operation and has a bearing with good supportability.

To achieve the above and other objects, the present invention provides a disassembling tool, including: a main body, a screw rod, a screw barrel and a bearing. The main body includes a first end portion, a second end portion opposite to the first end portion and a receiving space disposed between the first end portion and the second end portion. The first end portion includes a through hole, and the second end portion is configured to be abutted against an object to be disassembled. The screw rod penetrates through the through hole and includes a head portion. The screw barrel is screwed on the screw rod, and the screw barrel incudes an assembling portion configured to be assembled with a tool. The bearing is sleeved to the screw rod, and the bearing is disposed between the first end portion and the head portion of the screw rod. The bearing includes an inner ring, an outer ring sleeved on and being rotatable relative to the inner ring, and a plurality of rollers. The inner ring includes a first base board and a first annular portion which are transversely connected with each other, and the outer ring includes a second base board and a second annular portion which are transversely connected with each other. The plurality of rollers are abutted against and between the first and second base boards and between the first and second annular portions. One of the first base board and the second base board faces toward the head portion of the screw rod, and the other of the first base board and the second base board faces toward the first end portion. The second end portion includes an arcuate concave radially disposed thereon and an opening defined by the arcuate concave and being open radially, and the arcuate concave extends around an outer periphery of the screw rod and parts of the arcuate concave are located at two radial opposite sides of the screw rod.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
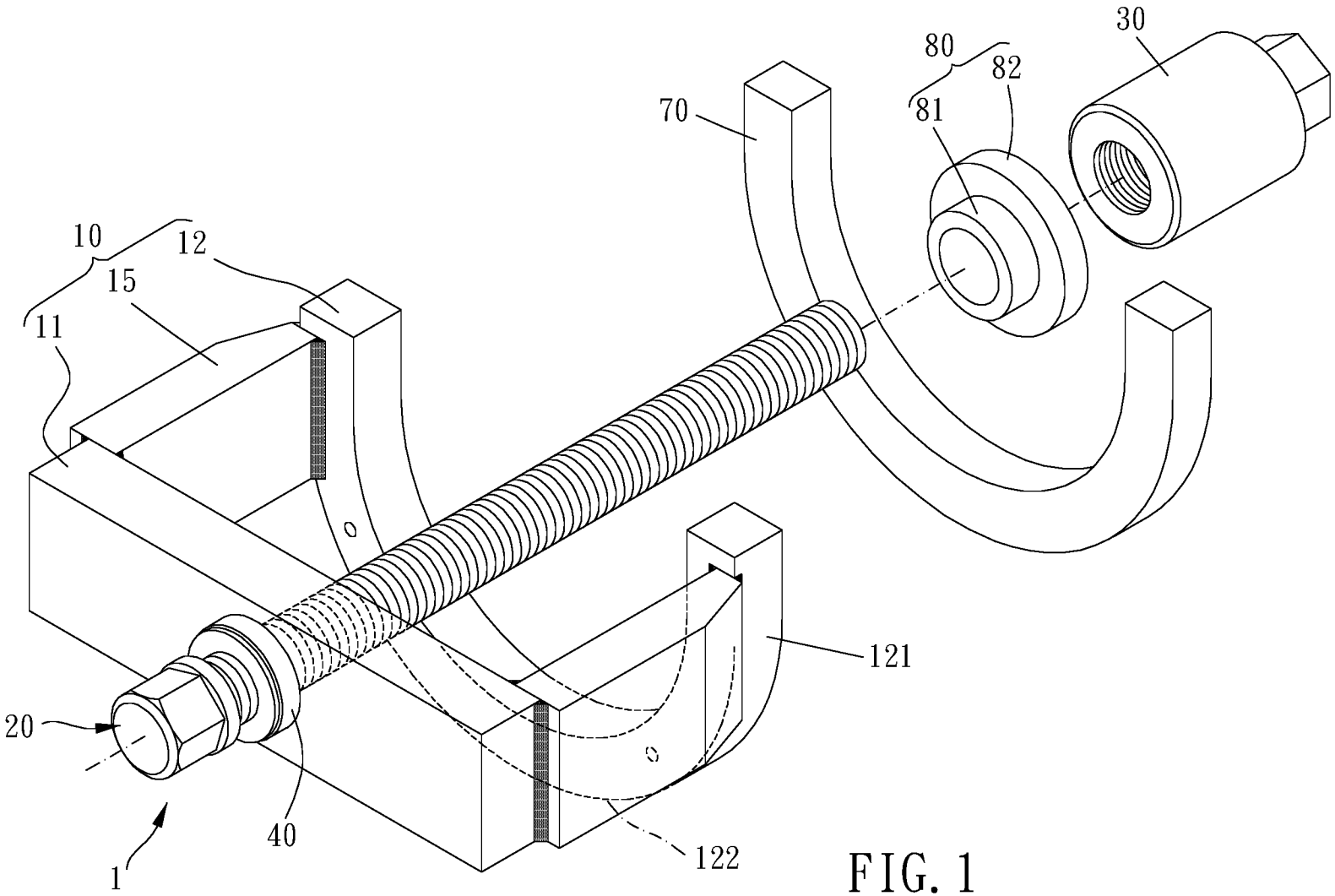
FIG. 1 is a breakdown drawing of a preferable embodiment of the present invention.
Figure 2:
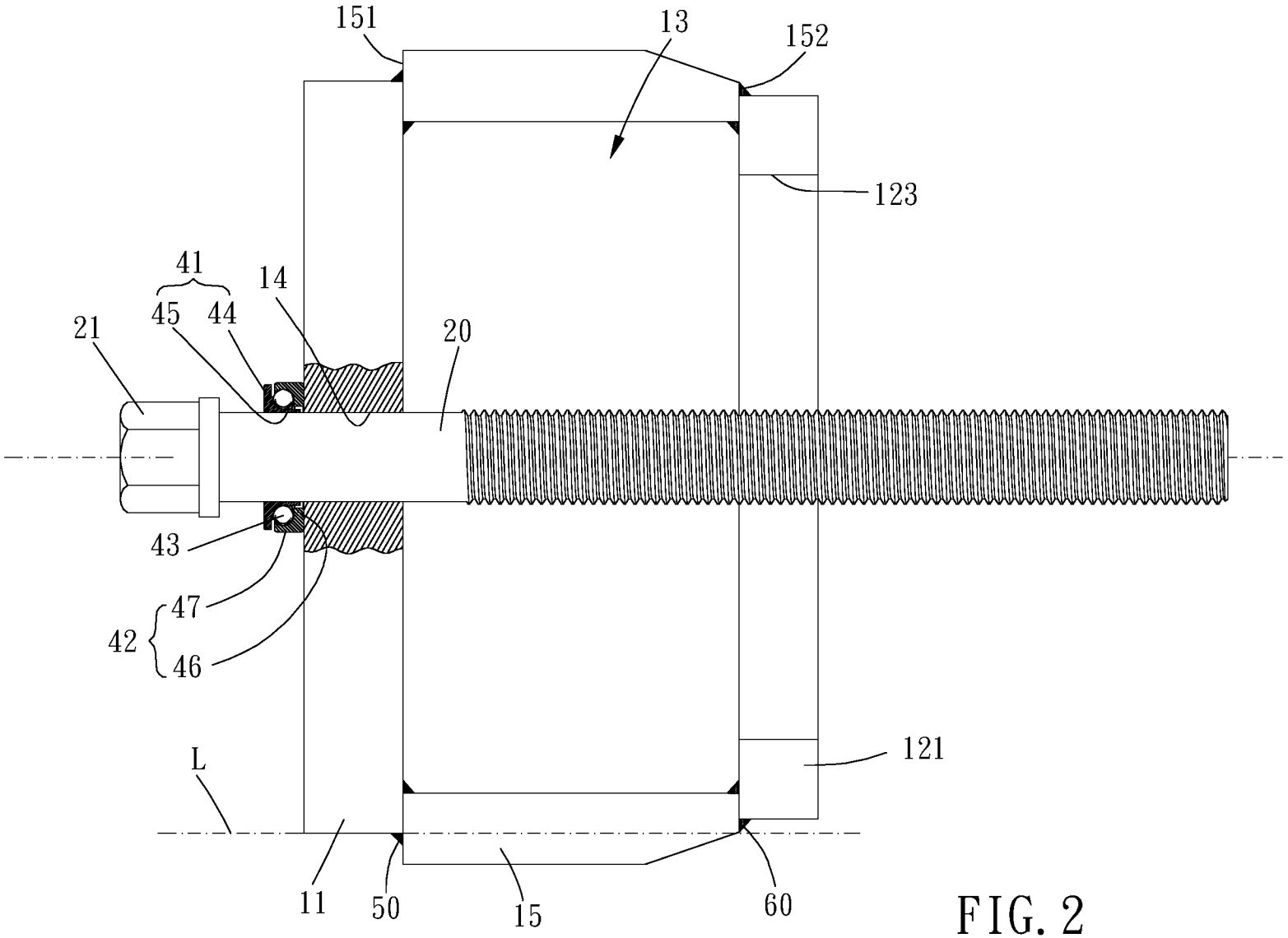
FIG. 2 is a top view of a preferable embodiment of the present invention.
Figure 3:
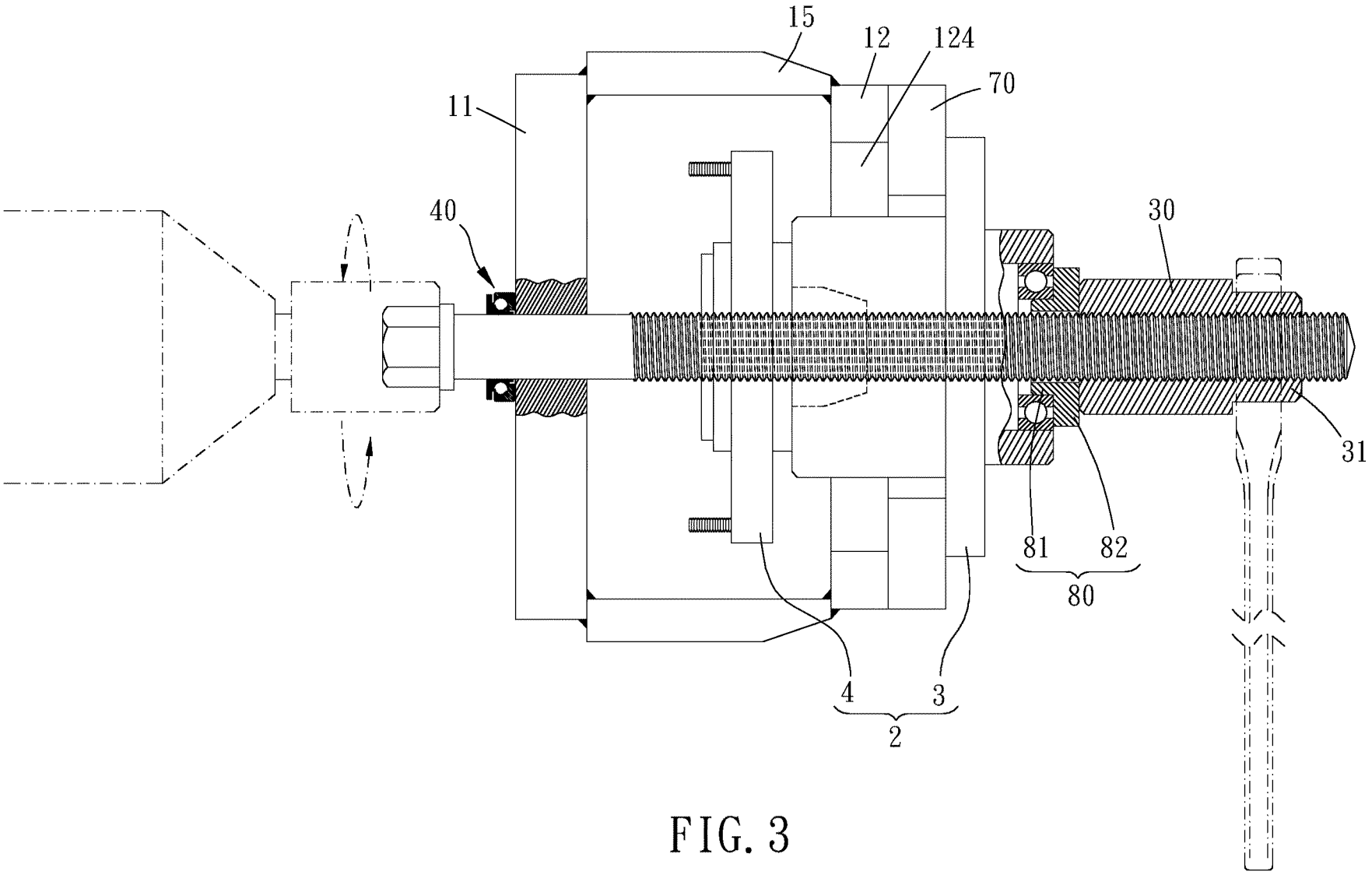
FIGS. 3 and 4 are schematic diagrams of a preferable embodiment of the present invention in use.
Figure 3A:
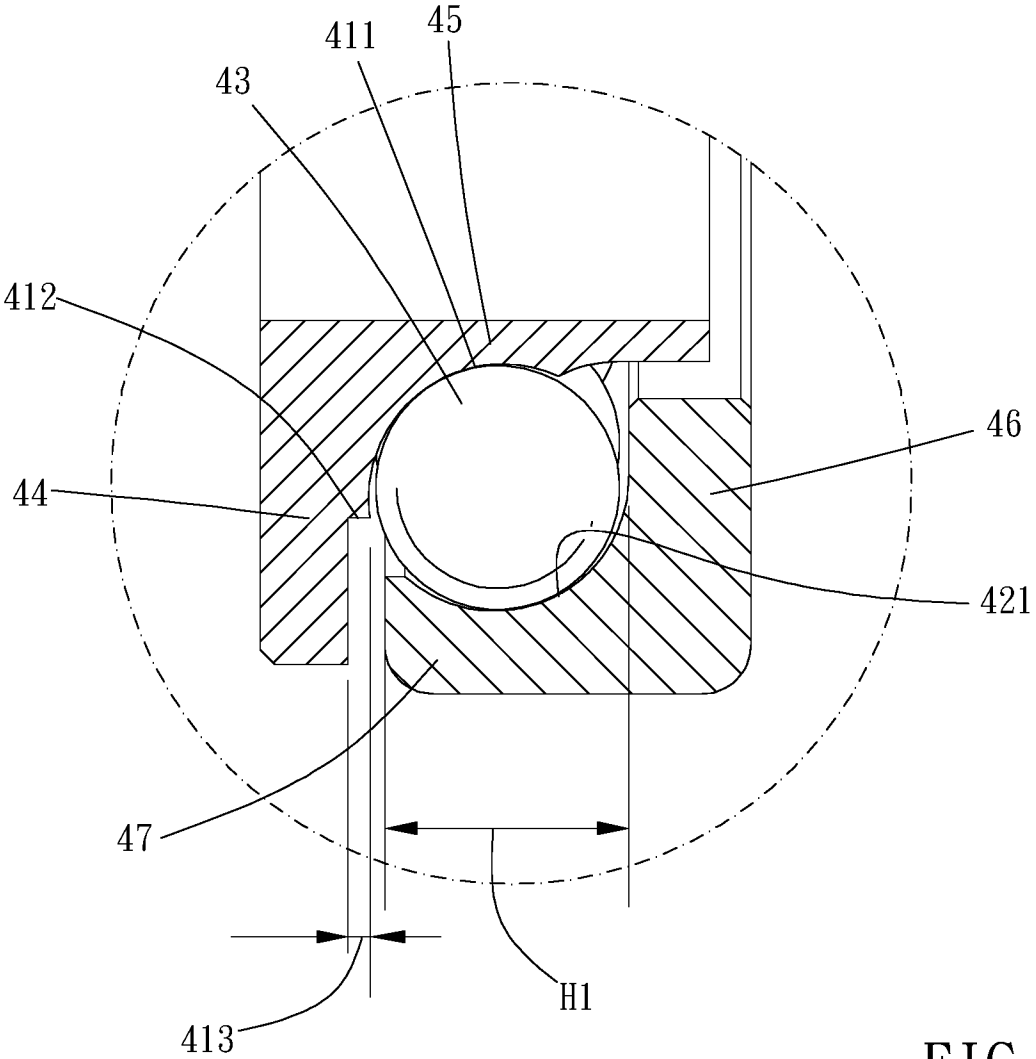
FIG. 3A is a partial enlargement of FIG. 3.
Figure 4:
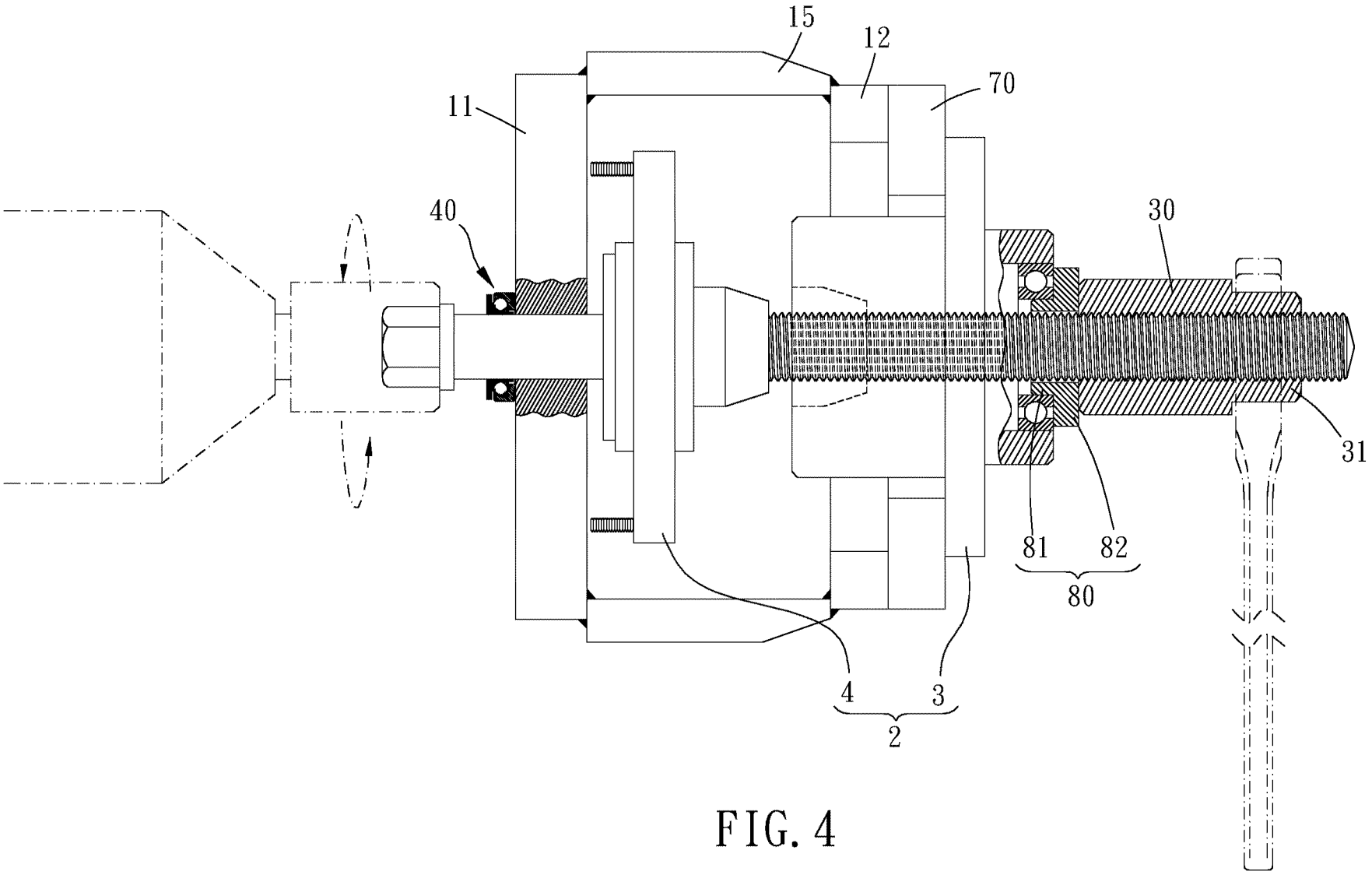

Please refer to FIGS. 1 to 4 and FIGS. 6 to 7 for a preferable embodiment of the present invention. A disassembling tool 1 of the present invention includes a main body 10, a screw rod 20, a screw barrel 30 and a bearing 40.

The main body 10 includes a first end portion 11, a second end portion 12 opposite to the first end portion 11 and a receiving space 13 disposed between the first end portion 11 and the second end portion 12. The first end portion 11 includes a through hole 14, and the second end portion 12 is configured to be abutted against an object to be disassembled (such as bearings, gears, axles or the like). The screw rod 20 penetrates through the through hole 14, and the screw rod 20 includes a head portion 21. In this embodiment, the head portion 21 is hexagonal and configured to be assembled with a rotatory tool (such as wenches, pneumatic tools, etc.). The screw barrel 30 is screwed on the screw rod 20, and the screw barrel 30 includes an assembling portion 31 configured to be assembled with a tool (such as wrenches). The bearing 40 is sleeved to the screw rod 20, and the bearing 40 is disposed between the first end portion 11 and the head portion 21 of the screw rod 20. The bearing 40 includes an inner ring 41, an outer ring 42 sleeved on and being rotatable relative to the inner ring 41, and a plurality of rollers 43. The inner ring 41 includes a first base board 44 and a first annular portion 45 which are transversely connected with each other, and the outer ring 42 includes a second base board 46 and a second annular portion 47 which are transversely connected with each other. The plurality of rollers 43 are abutted against and between the first and second base boards 44, 46 and between the first and second annular portions 45, 47. One of the first base board 44 and the second base board 46 faces toward the head portion 21 of the screw rod 20, and the other of the first base board 44 and the second base board 46 faces toward the first end portion 11. Therefore, the disassembling tool 1 is convenient for operation and the bearing 40 provides the first end portion 11 and the head portion 21 with good supportability. In operation, each of the head portion 21 of the screw rod 20 and the first end portion 11 is directly or indirectly abutted against one of the first base board 44 and the second base board 46 located at two opposite sides of the bearing 40 so that the screw rod 20 is smoothly rotatable relative to the first end portion 11 without abrasion. In other embodiments, at least one spacer or at least one nut may be disposed between the head portion of the screw rod and the bearing, and at least one spacer or at least one nut may be disposed between the first end portion and the bearing.

In this embodiment, the first end portion 11 is a cuboid which is not easy to deform. In other embodiments, the first end portion may be a sheet, rod, plate, or the like.

The main body 10 further includes at least one arm portion 15, and each of the at least one arm portion 15 is connected between the first end portion 11 and the second end portion 12. In this embodiment, the main body 10 includes two arm portions 15, and each of the two arm portions 15 has a first connecting surface 151 connected with the first end portion 11 and a second connecting surface 152 connected with the second end portion 12; a dimension of the first connecting surface 151 is larger than a dimension of the second connecting surface 152 so that the main body 10 has good structural strength and the first end portion 11 and the second end portion 12 are preferably connected with the two arm portions 15. Preferably, each of the two arm portions 15 is connected with the first end portion 11 and the second end portion 12 in a first direction. An outmost connecting point of a respective one of the two arm portions 15 and the second end portion 12 is located between an imaginary line L passing through an outmost connecting point of respective one of the two arm portions 15 and the first end portion 11 and the screw rod 20, and the imaginary line L is parallel with the first direction, which increases structural strength and avoids swinging of each of the two arm portions 15 relative to the first end portion 11. The second end portion 12 includes an arcuate concave 124 radially disposed thereon and an opening 123 defined by the arcuate concave 124 and being open radially. The arcuate concave 124 extends around an outer periphery of the screw rod 20 and parts of the arcuate concave 124 are located at two radial opposite sides of the screw rod 20.

The second end portion 12 is a horseshoe ring and can be rapidly and directly assembled with the object to be disassembled. The horseshoe ring includes two arm segments 121, a connecting segment 122 connected between the two arm segments 121 and the opening 123, and the first end portion 11 is transversely connected with the two arm segments 121 for stable operation and being convenient for application of force to disassemble the object. Each of the two arm portions 15 is connected with one of the two arm segments 121. The opening 123 defines an opening direction, and in the opening direction, each of the two arm portions 15 and an end surface of one of the two arm segments 121 are offset from each other for stable operation without rock. The arcuate concave 124 is disposed on the connecting segment 122.

The first end portion 11 and respective one of the two arm portions 15, at two opposite corners disposed therebetween, are connected with each other by first soldering portions 50; the second end portion 12 and respective one of the two arm portions 15, at two opposite corners disposed therebetween, are connected with each other by second soldering portions 60 so as to increase connection strength.

The disassembling tool 1 further includes at least one pad 70, and the at least one pad 70 is disposed between the second end portion 12 and the screw barrel 30. In this embodiment, each of the at least one pad 70 is a U-ring, and the at least one pad may be a C-ring, plate, or the like. Moreover, the at least one pad 70 is disposed between the second end portion 12 and the object to be disassembled, for stable position and support. The disassembling tool 1 further includes an annular block 80. The annular block 80 includes a small diameter tubular segment 81 and a large diameter tubular segment 82, and the annular block 80 is sleeved on the screw rod 20 and located between the first end portion 11 and the screw barrel 30. The small diameter tubular segment 81 is configured to be abutted against the object to be disassembled (such as a bearing).

As viewed in a radial direction of the bearing 40, the outer ring 42 is inverted-U shape, the inner ring 41 is convex shaped, and the first annular portion 45 does not protrude axially beyond an end of the second base board 46 away from the plurality of rollers 43, which prevents the first annular portion 45 from being axially abutted against one of the first end portion 11 and the head portion 21 of the screw rod 20 and from resulting in additional friction when the inner ring 41 and the outer ring 42 are rotated relative to each other. The inner ring 41 further includes a first guiding surface 411 connected between an outer wall of the first annular portion 45 and the first base board 44, and the outer ring 42 further includes a second guiding surface 421 connected between an inner wall of the second annular portion 47 and the second base board 46. The plurality of rollers 43 are abutted against and between the first guiding surface 411 and the second guiding surface 421 so as to good support in an axial direction.

A first stepped portion 412 is disposed between the first guiding surface 411 and the first base board 44 and a height difference 413 is formed between the first guiding surface 411 and the first base board 44. A length of the second annular portion 47 extending axially from the second base board 46 is defined as a first height H1, and a sum of the height difference 413 and the first height H1 is larger than a radius of at least one of the plurality of rollers 43, which prevents end surfaces of the first base board 44 and the second annular portion 47 from contacting each other and from producing additional friction between the inner ring 41 and the outer ring 42.

The plurality of rollers 43 are balls, and the first guiding surface 411 and the second guiding surface 421 are arcuate guiding surfaces. Radiuses of curvature of the first guiding surface 411 and the second guiding surface 421 are respectively larger than the radius of at least one of the plurality of rollers 43 so that the plurality of rollers 43 are smoothly rotatable between the first guiding surface 411 and the second guiding surface 421. Preferably, the radiuses of curvature of the first guiding surface 411 and the second guiding surface 421 are the same, and a ratio of the radius of at least one of the plurality of rollers 43 to a radius of curvatures of the first guiding surface 411 is between 2.5:2.6 and 2.5:2.9. In this embodiment, the ratio is 2.5:2.75 so that the inner ring 41 and the outer ring 42 are axially and radially movable relative to each other without contacting each other, which tolerates manufacturing tolerances of the inner ring 41, the plurality of rollers 43 and the outer ring 42 in assembling.

Figure 5:
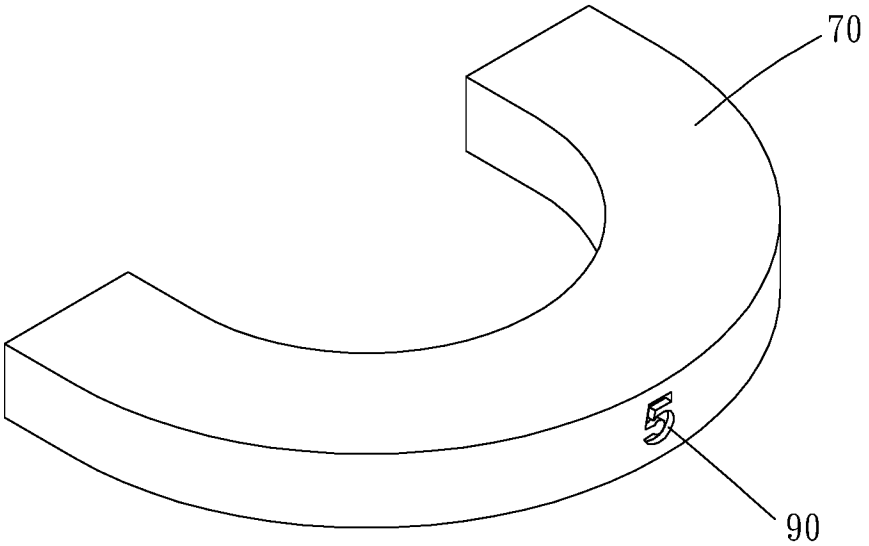
FIG. 5 is a stereogram of a pad of a preferable embodiment of the present invention.
Figure 6:
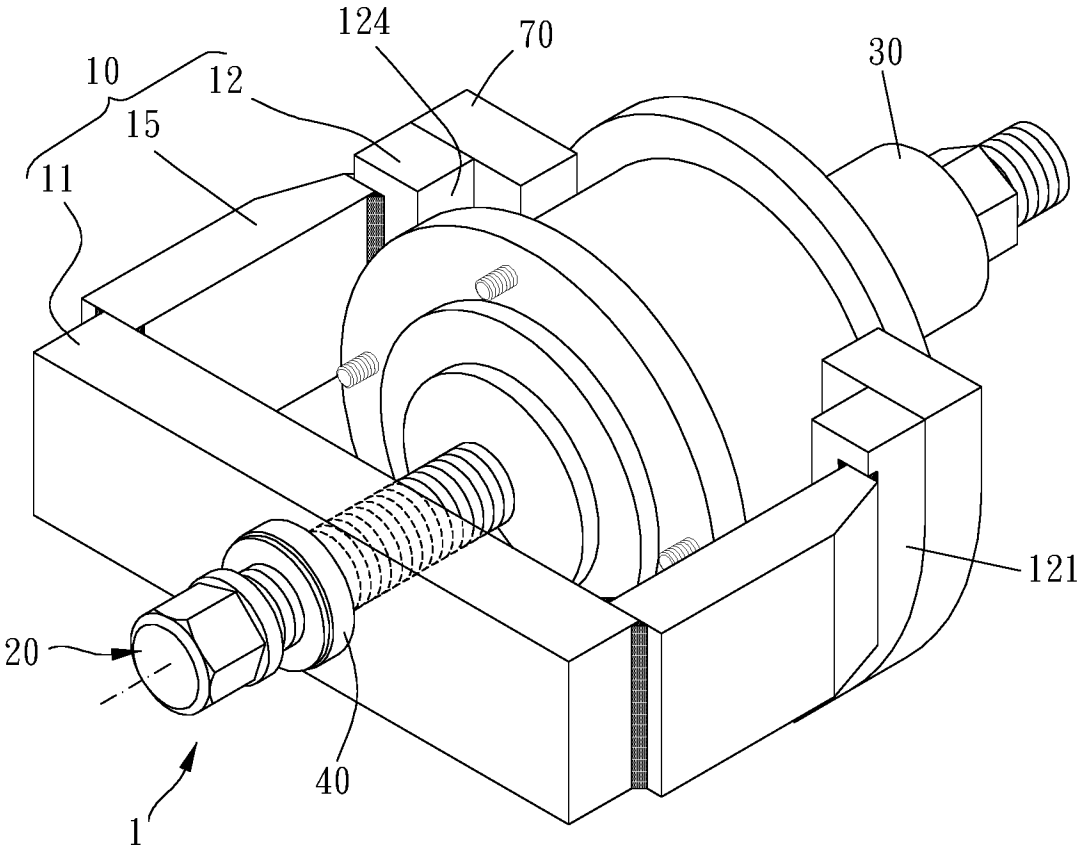
FIG. 6 is a stereogram of a preferable embodiment of the present invention in use.
Figure 7:
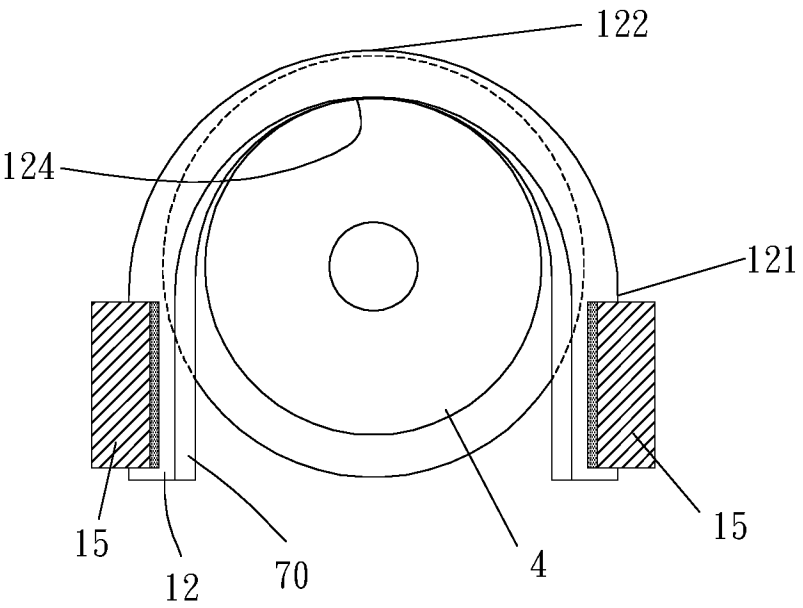
FIG. 7 is another schematic diagram of a preferable embodiment of the present invention in use.

Please refer to FIG. 5, an outer side of at least one of the main body 10, the screw barrel 30, the annular block 80 and the pad 70 has a labeling portion 90 for easy recognition. In this embodiment, the labeling portion 90 is engraved (such as by laser engraving) on at least one of the components described above and is not easy to peel off. In other embodiments, the labeling portion may be printed on at least one of the components described above.

In this embodiment, the object to be disassembled may be a wheel hub assembly 2. In operation, the second end portion 12 is abutted against a bearing housing 3 of the wheel hub assembly 2, and a part of the bearing housing 3 is located within the receiving space 13. The screw barrel 30 is fixed by the tool, and the rotatory tool is assembled to the head portion 21 of the screw rod 20 to rotate the screw rod 20 so that the screw barrel 30 is moved in a direction toward the head portion 21 until the screw barrel 30 is abutted against a wheel hub 4 of the wheel hub assembly 2, and then the head portion 21 and the screw barrel 30 are moved in opposite directions for disassembling the wheel hub 4.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A disassembling tool, including:

a main body, including a first end portion, a second end portion opposite to the first end portion and a receiving space disposed between the first end portion and the second end portion, the first end portion including a through hole, the second end portion being configured to be abutted against an object to be disassembled;

a screw rod, penetrating through the through hole, the screw rod including a head portion;

a screw barrel, screwed on the screw rod, the screw barrel including an assembling portion configured to be assembled with a tool;

a bearing, being sleeved to the screw rod, the bearing being disposed between the first end portion and the head portion of the screw rod, the bearing including an inner ring, an outer ring sleeved on and being rotatable relative to the inner ring, and a plurality of rollers, the inner ring including a first base board and a first annular portion which are transversely connected with each other, the outer ring including a second base board and a second annular portion which are transversely connected with each other, the plurality of rollers being abutted against and between the first and second base boards and between the first and second annular portions, one of the first base board and the second base board facing toward the head portion of the screw rod, and the other of the first base board and the second base board facing toward the first end portion;

wherein the second end portion includes an arcuate concave radially disposed thereon and an opening defined by the arcuate concave and being open radially, and the arcuate concave extends around an outer periphery of the screw rod and parts of the arcuate concave are located at two radial opposite sides of the screw rod;

wherein the main body further includes at least one arm portion, and each of the at least one arm portion is connected between the first end portion and the second end portion;

wherein each of the at least one arm portion has a first connecting surface connected with the first end portion and a second connecting surface connected with the second end portion, and a dimension of the first connecting surface is larger than a dimension of the second connecting surface.

2. The disassembling tool of claim 1, wherein each of the at least one arm portion is connected with the first end portion and the second end portion in a first direction, an outmost connecting point of a respective one of the at least one arm portion and the second end portion is located between an imaginary line passing through an outmost connecting point of a respective one of the at least one arm portion and the first end portion and the screw rod, and the imaginary line is parallel with the first direction.

3. A disassembling tool, including:

a main body, including a first end portion, a second end portion opposite to the first end portion and a receiving space disposed between the first end portion and the second end portion, the first end portion including a through hole, the second end portion being configured to be abutted against an object to be disassembled;

a screw rod, penetrating through the through hole, the screw rod including a head portion;

a screw barrel, screwed on the screw rod, the screw barrel including an assembling portion configured to be assembled with a tool;

a bearing, being sleeved to the screw rod, the bearing being disposed between the first end portion and the head portion of the screw rod, the bearing including an inner ring, an outer ring sleeved on and being rotatable relative to the inner ring, and a plurality of rollers, the inner ring including a first base board and a first annular portion which are transversely connected with each other, the outer ring including a second base board and a second annular portion which are transversely connected with each other, the plurality of rollers being abutted against and between the first and second base boards and between the first and second annular portions, one of the first base board and the second base board facing toward the head portion of the screw rod, and the other of the first base board and the second base board facing toward the first end portion;

wherein the second end portion includes an arcuate concave radially disposed thereon and an opening defined by the arcuate concave and being open radially, and the arcuate concave extends around an outer periphery of the screw rod and parts of the arcuate concave are located at two radial opposite sides of the screw rod;

wherein the second end portion is a horseshoe ring, the horseshoe ring includes two arm segments, a connecting segment connected between the two arm segments and the opening, the first end portion is transversely connected with the two arm segments, and the arcuate concave is disposed on the connecting segment.

4. The disassembling tool of claim 3, wherein the main body further includes two arm portions, each of the two arm portions is connected with one of the two arm segments, the opening defines an opening direction, and in the opening direction, each of the two arm portions and an end surface of one of the two arm segments are offset from each other.

5. The disassembling tool of claim 1, wherein the inner ring further includes a first guiding surface connected between an outer wall of the first annular portion and the first base board, the outer ring further includes a second guiding surface connected between an inner wall of the second annular portion and the second base board, and the plurality of rollers are abutted against and between the first guiding surface and the second guiding surface.

6. A disassembling tool, including:

a main body, including a first end portion, a second end portion opposite to the first end portion and a receiving space disposed between the first end portion and the second end portion, the first end portion including a through hole, the second end portion being configured to be abutted against an object to be disassembled;

a screw rod, penetrating through the through hole, the screw rod including a head portion;

a screw barrel, screwed on the screw rod, the screw barrel including an assembling portion configured to be assembled with a tool;

a bearing, being sleeved to the screw rod, the bearing being disposed between the first end portion and the head portion of the screw rod, the bearing including an inner ring, an outer ring sleeved on and being rotatable relative to the inner ring, and a plurality of rollers, the inner ring including a first base board and a first annular portion which are transversely connected with each other, the outer ring including a second base board and a second annular portion which are transversely connected with each other, the plurality of rollers being abutted against and between the first and second base boards and between the first and second annular portions, one of the first base board and the second base board facing toward the head portion of the screw rod, and the other of the first base board and the second base board facing toward the first end portion;

wherein the second end portion includes an arcuate concave radially disposed thereon and an opening defined by the arcuate concave and being open radially, and the arcuate concave extends around an outer periphery of the screw rod and parts of the arcuate concave are located at two radial opposite sides of the screw rod;

wherein the inner ring further includes a first guiding surface connected between an outer wall of the first annular portion and the first base board, the outer ring further includes a second guiding surface connected between an inner wall of the second annular portion and the second base board, and the plurality of rollers are abutted against and between the first guiding surface and the second guiding surface;

wherein a first stepped portion is disposed between the first guiding surface and the first base board and a height difference is formed between the first guiding surface and the first base board, a length of the second annular portion extending axially from the second base board is defined as a first height, and a sum of the height difference and the first height is larger than a radius of at least one of the plurality of rollers.

7. The disassembling tool of claim 5, wherein the plurality of rollers are balls, the first guiding surface and the second guiding surface are arcuate guiding surfaces; radiuses of curvature of the first guiding surface and the second guiding surface are respectively larger than a radius of at least one of the plurality of rollers.

8. The disassembling tool of claim 4, wherein the first end portion is a cuboid; each of the two arm portions is connected between the first end portion and the second end portion; each of two arm portions includes a first connecting surface connected with the first end portion and a second connecting surface connected with the second end portion, a dimension of the first connecting surface is larger than a dimension of the second connecting surface; each of the two arm portions is connected with the first end portion and the second end portion in a first direction, an outmost connecting point of a respective one of the two arm portions and the second end portion is located between an imaginary line passing through an outmost connecting point of a respective one of the two arm portions and the first end portion and the screw rod, the imaginary line is parallel with the first direction; the inner ring further includes a first guiding surface connected between an outer wall of the first annular portion and the first base board, the outer ring further includes a second guiding surface connected between an inner wall of the second annular portion and the second base board, the plurality of rollers are abutted against and between the first guiding surface and the second guiding surface; a first stepped portion is disposed between the first guiding surface and the first base board and a height difference is formed between the first guiding surface and the first base board, a length of the second annular portion extending axially from the second base board defines a first height, a sum of the height difference and the first height is larger than a radius of at least one of the plurality of rollers; the plurality of rollers are balls, the first guiding surface and the second guiding surface are arcuate guiding surfaces; radiuses of curvatures of the first guiding surface and the second guiding surface are respectively larger than a radius of at least one of the plurality of rollers; the radiuses of curvature of the first guiding surface and the second guiding surface are the same, a ratio of the radius of at least one of the plurality of rollers to a radius of curvatures of the first guiding surface is between 2.5:2.6 and 2.5:2.9; as viewed in a radial direction of the bearing, the outer ring is inverted-U shaped, the inner ring is convex shaped, the first annular portion does not protrude axially beyond an end of the second base board away from the plurality of rollers; the first end portion and respective one of the two arm portions, at two opposite corners disposed therebetween, are connected with each other by first soldering portions; the second end portion and respective one of the two arm portions, at two opposite corners disposed therebetween, are connected with each other by second soldering portions; the disassembling tool further includes at least one pad, the at least one pad is disposed between the second end portion and the screw barrel; the disassembling tool further includes an annular block, the annular block includes a small diameter tubular segment and a large diameter tubular segment, the annular block is sleeved on the screw rod and located between the first end portion and the screw barrel; an outer side of at least one of the main body, the screw barrel, the annular block and the pad has a labeling portion.

* * * * *